United States Patent [19]

Shinn et al.

[11] Patent Number: 4,548,284

[45] Date of Patent: Oct. 22, 1985

[54] ROLLER BALL RETENTION OF REAMER CUTTER ASSEMBLY

[75] Inventors: Calvin W. Shinn; Robert G. Terry, both of Odessa, Tex.

[73] Assignee: Dresser Industries, Inc., Dallas, Tex.

[21] Appl. No.: 546,754

[22] Filed: Oct. 28, 1983

[51] Int. Cl.[4] ..... E21B 10/30

[52] U.S. Cl. ..... 175/346; 175/325; 175/347; 175/406

[58] Field of Search ..... 175/73, 258, 325, 342, 175/344, 345, 346, 347, 406, 408

[56] References Cited

U.S. PATENT DOCUMENTS

| | | | |
|---|---|---|---|
| 1,999,132 | 4/1935 | Reed | 175/346 |
| 2,126,146 | 8/1938 | Smith | 255/74 |
| 2,589,534 | 3/1952 | Buttolph | 255/28 |
| 2,758,891 | 8/1956 | Kammerer | 308/4 |
| 3,627,068 | 12/1971 | Wagnon | 175/342 |
| 4,182,425 | 1/1980 | Garrett | 175/228 |
| 4,190,124 | 2/1980 | Terry | 175/406 |
| 4,261,426 | 4/1981 | Garrett | 175/228 |

*Primary Examiner*—Stephen J. Novosad
*Assistant Examiner*—M. Goodwin
*Attorney, Agent, or Firm*—Fred A. Winans

[57] ABSTRACT

A roller reamer/stabilizer tool is shown with rolling cutter assemblies removeably retained within elongated pockets in the body of the tool by cap members capturing opposing ends of the cutter axle pin. The cap members are received in sockets adjacent opposed ends of the pockets and secured thereon by balls, received within a passage defined by the mating faces of the socket and caps, and by threaded bolts. A countersunk bore in the cap members receives the bolts therethrough and provides an entry into a transverse opening through the cap to the passage for inserting or removing the balls. A shim plate between the cap and the body determine the gauge diameter of the tool.

7 Claims, 4 Drawing Figures

ROLLER BALL RETENTION OF REAMER CUTTER ASSEMBLY

BACKGROUND OF THE INVENTION

1. Field of the Invention

The present invention relates generally to roller reamer tools useful in drilling of earth formations during exploration for and production of oil and natural gas; and, particularly to structure for mounting the roller cutters to the tool body.

2. Description of the Prior Art

Roller reamers are down-the-hole tools adapted to be placed in various positions in the drill string used to drill oil and gas wells. The roller reamers are used to ream the borehole to accurate gauge diameter; or are used as stabilizers to keep the drill string straight and centered in the borehole. The use of the tool in a particular application will dictate whether the tool is assembled with roller cutters having cutting teeth to actually ream the hole or with smooth faced rollers (cutters) to function as a stabilizer.

Generally, a roller reamer comprises a cylindrical body having upper and lower end portions, threaded for connection with adjacent drill string members, and an intermediate portion. The intermediate portion is generally larger in diameter than the end portions and contains a plurality of axially elongated pockets spaced about its periphery to receive the roller reamer cutter assemblies.

A roller reamer cutter assembly is disposed in each pocket and comprises a roller cutter mounted for rotation on a main pin. The pin is attached, by various means, within the cavity to the body. Predominantly, the ends of the main pin are fitted into mounting blocks which are then welded, pressed into mating pocket structure, or bolted to the body, or various combinations of these mounting techniques.

It is desirable to provide a roller reamer tool that is field serviceable so that roller cutters may be replaced when worn out. It is also desirable to reuse the bodies since they are a very costly item.

Further, it is desirable to support the rollers on the tool body in a manner that permits a selection of various radial locations so that a body and cutter assembly can be adjusted, within a limited range, to contact or ream holes of various gauges or diameters.

The desire to replace worn cutters and salvage the bodies or to vary the gauge diameter of the tool is indicated by a number of patents directed to removeable, replaceable mounting means for the roller reamer cutter assemblies. Many methods of removably attaching the cutter assemblies are costly or difficult to machine or damaging to the body, as when welds are removed. For ease of machining and reduced cost, providing cylindrical mounting blocks fitted into cylindrical bores or sockets in the body adjacent each end of the roller cutter pockets is beneficial.

Illustrative of the use of cylindrical mounting blocks are:

| | |
|---|---|
| Garrett | 4,182,425 |
| Abegg | 2,134,095 |
| Catland | 2,199,693 |
| Catland | 2,084,430 |
| Garrett | 4,261,426 |

-continued

| | |
|---|---|
| Allison et al | 4,262,760 |

Garrett, U.S. Pat. No. 4,182,425, discloses cylindrical mounting blocks which are stepped on their sides and press-fit into mating bores in the body. These are additionally held in place by bolts. The reamer main pin upon which the roller cutter rotates is inserted into a bore in the mounting block and either welded or pinned to the mounting block to prevent its movement. Also disclosed are means for removal of the mounting blocks from the body.

After repeated installation and removal of the blocks to replace worn roller cutters, the blocks and the sockets become worn on their cylindrical sides resulting in loss of the interference fit. Thus, the blocks are retained primarily by the mounting bolts, which can become loose. There is then substantial risk of damage to the reamer which could become severe enough to cause loss of parts in the hole, necessitating a very costly and time-consuming fishing job to remove the lost parts from the borehole.

It is an object of the present invention to provide a roller reamer that is readily field serviceable.

Another object of the invention is to provide roller reamer mounting means that will assure positive retention of the roller cutter assemblies.

Another object of the invention is to provide a roller reamer mounting means that permits a single body to be used to ream boreholes to various gauge diameters.

SUMMARY OF THE INVENTION

The present invention overcomes the above-identified block-mounting problems by providing a roller reamer having mounting caps for the roller cutter assemblies positively retained in the body yet readily repeatedly removed without affecting the initial retention capabilities. The mounting caps are retained without an interference fit in opposed aligned cavities or sockets in the tool body. The opposed end wall of each socket has an arcuate groove formed therein and the mounting caps have an opposed arcuate groove formed in the endwall thereof mating with the cavity groove to form therebetween, when the cap is properly disposed in the socket, a tubular chamber of generally constant diameter.

The mounting caps also have countersunk front to back openings in alignment with threaded openings in the tool body disposed in the bottoms of the sockets for receiving a headed bolt securing the cap to the body. Transverse passages are provided in the cap and extend from each countersunk opening to the arcuate groove in each cap. Balls are inserted through the transverse passages into the tubular passage bridging or extending across the facing surfaces of the cap and cavity. A headed bolt is fitted through the countersunk opening in the cap and into the threaded opening in the bottom of each cavity to close the transverse passages and additionally secure the mounting cap within the cavity. A locking ring (jam nut) is then threadably secured in the countersunk opening against the top of the headed bolt to prevent any movement or loosening of the retainer bolt.

A shim member can be disposed between the back face of the cap and the base of the socket to determine the diametral positioning of the pin on the body. The caps and shims are paired such that the groove in the cap is maintained in proper alignment with the groove in the cavity to define the tubular passage.

DESCRIPTION OF THE PREFERRED EMBODIMENT

Figure 1:
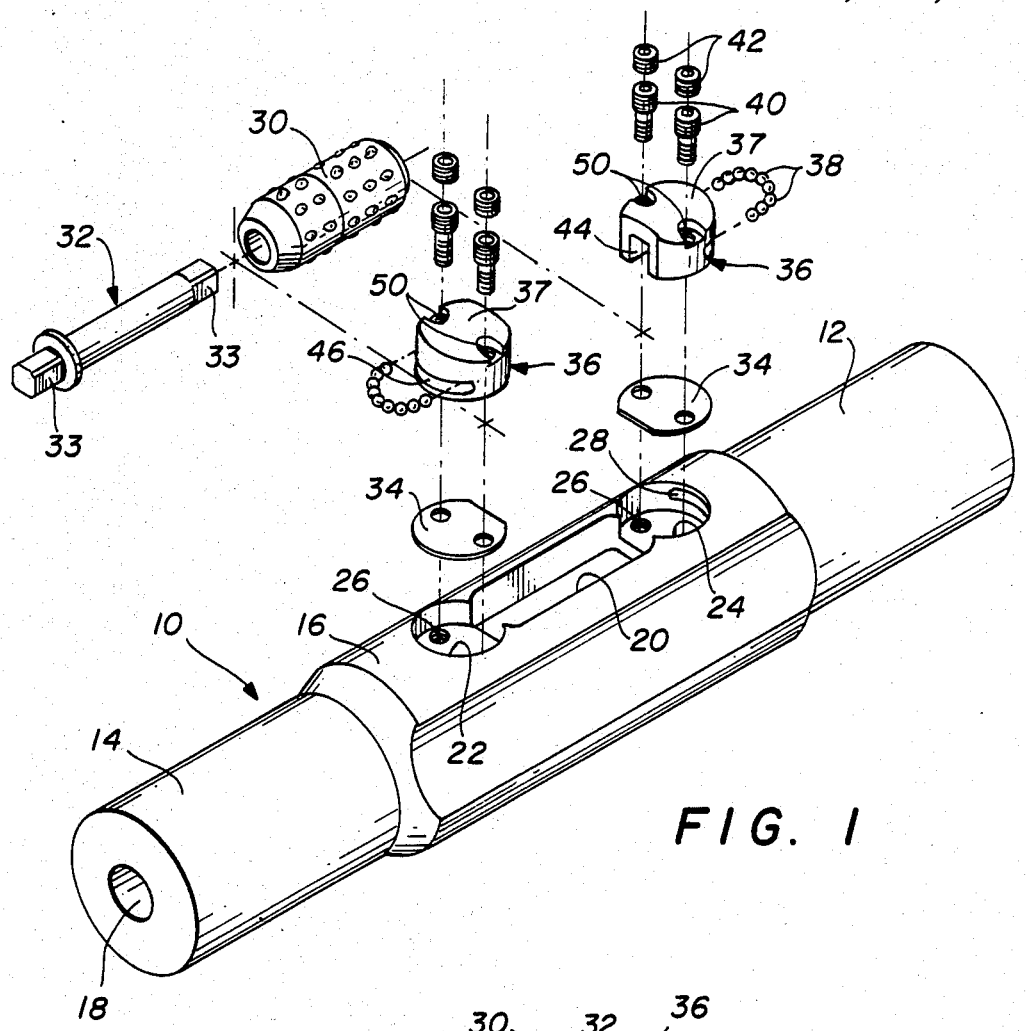
FIG. 1 is an exploded assembly drawing of the roller reamer of the present invention.
Figure 3:
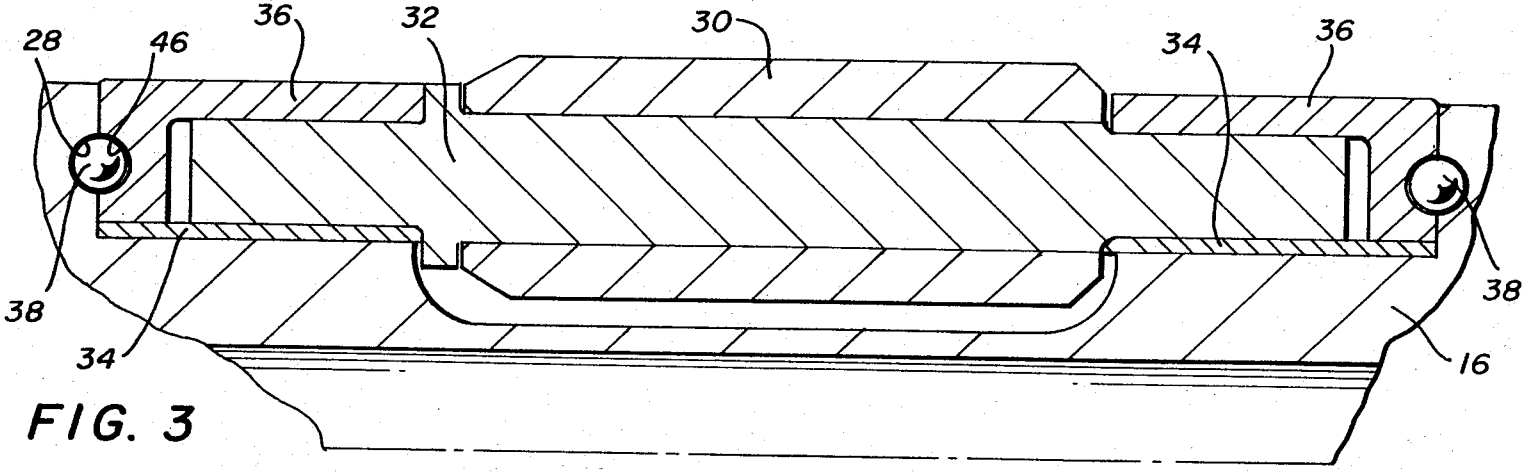
FIG. 3 is a view taken along section line 3—3 of FIG. 2 showing the shim plate as installed.

Referring now to FIG. 1, an exploded assembly view of a roller reamer of the present invention, is shown. The reamer comprises a cylindrical body 10 having upper, lower, and intermediate portions 12, 14, and 16, respectively. The upper and lower end portions 12 and 14 are threaded for connection to adjacent drill string members (threads not shown). Flow passage 18 extends axially through the center of body 10 for the circulation of drilling fluid through the tool. Intermediate portion 16 is generally larger in diameter than the upper and lower end portions 12 and 14 and has formed therein a plurality of axially elongated pockets 20 spaced about the periphery. (FIG. 1 shows only one of the pockets 20, however, normally three such pockets 20 are equally spaced about the body.) Cylindrical sockets 22 and 24 are machined into the intermediate portion 16 adjacent and opening into each end of pocket 20 and on a common axially aligned centerline. The sockets are also at a common depth generally raised from the bottom of pocket 20. Threaded openings 26 are machined into the bottoms of sockets 22 and 24, and an arcuate groove 28, semicircular in cross-section (see FIG. 3) is machined in each of the opposed arcuate end walls of the aligned sockets 22 and 24.

A roller cutter 30 is mounted for rotation on main pin 32 which has aligned flats 33 machined on its end portions. Shim plates 34 having a configuration generally coextensive with the sockets, are disposed on the bottoms of sockets 22 and 24. The assembled cutter 30 and main pin 32 are mounted in the body such that the cutter 30 is disposed in pocket 20 and the ends 33 of main pin 32 rest on shims 34 in each of aligned sockets 22 and 24.

Cylindrical mounting caps 36 are provided having diameters such that when installed in sockets 22 and 24 will result in a slight interference fit or a slight clearance fit with the cylindrical walls of the sockets. A slot 44 is milled into the bottom of each cap 36 to closely fit over the flat end portions of main pin 32. The caps 36 have an arcuate groove 46 semicircular in cross-section (see FIG. 3) in their end walls that are farthermost from the cutter pockets 20. Groove 46 is in alignment with facing groove 28 to form a tubular chamber 52 (see FIG. 2). The outer face 37 of each of the caps 36 is curved to conform to the cylindrical surface of intermediate portion 16. The caps 36 have coutersunk threaded openings 50, one on each side of the slot, and in alignment with threaded openings 26 in the bottoms of sockets 22 and 24.

Figure 2:
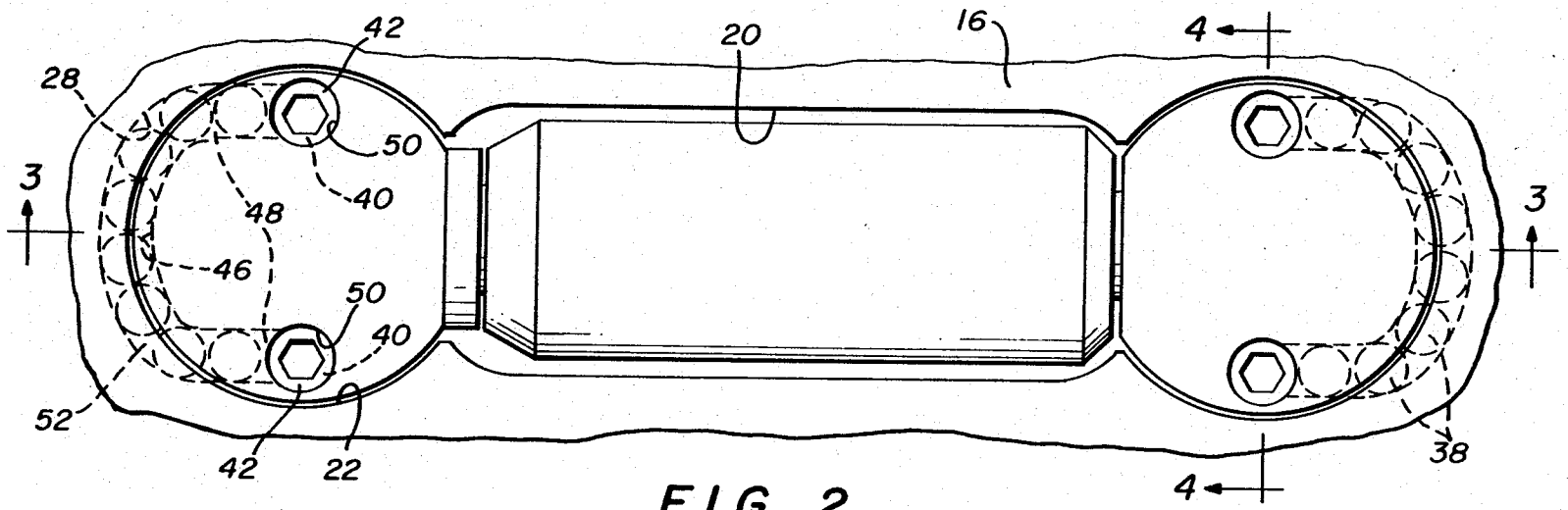
FIG. 2 is a side elevation view of the roller reamer of the present invention as assembled.

As seen in FIG. 2, the cap 36 also includes transverse passages 48 extending from each countersunk opening 50 to the arcuate groove 46. The mounting caps 36 are aligned and installed into sockets 22 and 24 such that the flat end portions of the main pin 32 are clamped between the shims 34 and the slot 44 in the caps, and the arcuate groove 46 in the caps is aligned with arcuate groove 28 in the end walls of sockets 22 and 24, thus forming tubular chamber 52 of generally constant diameter. It will be appreciated that as shims of various thicknesses are used, the placement of the groove 46 in the cap must likewise be varied, making the shim and appropriate cap a matched set, to maintain proper alignment between facing grooves 46 and 28. Further, thicker shim members 34 will cause the pin, and cutter assembly, to be displaced outwardly for larger gauge diameter holes.

Balls 38 are inserted through countersunk openings 50 into each of the transverse passages 48 and tubular passage 52 to substantially fill these passages. Thus, the caps 36 are retained in their respective sockets 22, 24 by the balls 38 in tubular chamber 52 bridging or extending across the facing surfaces of the block and cavity. Headed bolt 40 is then installed through countersunk opening 50 in the cap and through the aligned openings in the shim 34 and into the threaded openings 26 in the bottom of the sockets to also secure the cap to the body. The main pin 32 is thereby clamped in place to prevent its movement. A locking ring 42 is installed as by threaded engagement with opening 50 over the headed bolt to prevent the bolt from loosening during operation.

Figure 4:
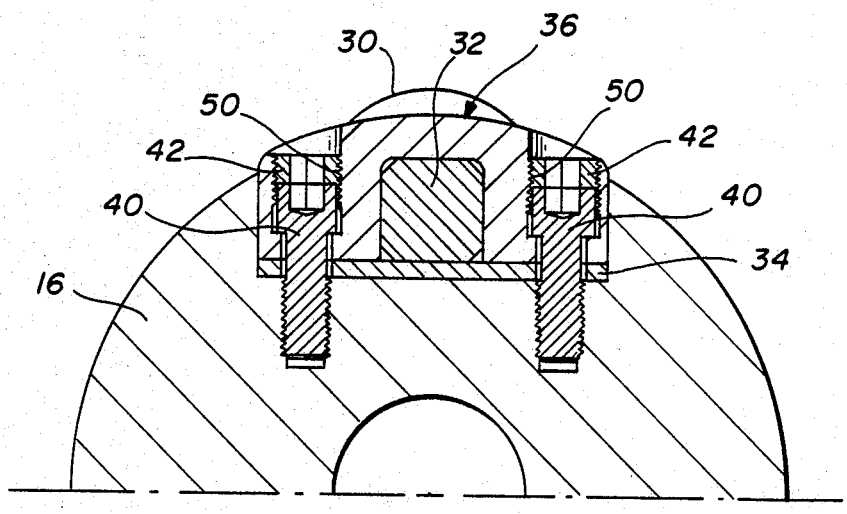
FIG. 4 is a view taken along section line 4—4 of FIG. 2 showing the locking rings (jam nuts) as installed.

To remove and replace the roller assembly one must merely remove locking rings 42 and remove bolts 40. Then, with air or fluid pressure applied to one of the transverse passages 48 the balls can be forced out of the tubular chamber and transverse passage 52, 48 respectively. (Other means for withdrawing the balls can also be used.) Once the balls are removed, a slide hammer, well known in the art, is threaded into the threaded countersunk opening 50 (see FIG. 4) and with impacts imparted thereto, withdraws the cap 36 from the socket 24, 26. This frees the cutter and main pin assembly for removal.

We claim:

1. A drilling tool for contacting the walls of a borehole comprising an elongated cylindrical body having a plurality of generally elongated pockets formed in the surface thereof and terminating at opposed ends in outwardly open sockets circumscribed by a sidewall; a cutter assembly including an earth engaging member rotatably mounted on axle means; and means for mounting said cutter assembly within said pocket such that the earth engaging member projects outwardly from the cylindrical body to contact the borehole; said mounting means comprising:

cap means defining means for capturing an end portion of said axle member; and having a sidewall generally coextensive with the sidewall of said socket, and;

means for securing said cap means to said body within said socket, said securing means including:

the sidewall of each cavity defining a first groove therein;

the sidewall of each said cap means defining a second groove therein which, when the cap is disposed within said cavity, cooperates with said first groove to form a tubular chamber;

a countersunk bore extending through said cap from the outer face to the opposite face thereof in alignment with a threaded opening in said socket and defining a first large diameter opening extending from the outer face of said cap means and terminating in a second reduced diameter bore extending from an intermediate position through said cap means;

a transverse passage extending through said cap from within said first large diameter opening to said second groove;

means inserted into said tubular chamber through said first large opening and said transverse passage for bridging the facing surfaces of said cap and socket and locking said cap within said socket; and, a headed bolt inserted within said countersunk bore and threaded into said threaded opening in said socket for further securing said cap to said body and blocking the transverse passage to prevent escape of said locking means in said tubular chamber.

2. Structure according to claim 1 wherein said locking means inserted into said tubular chamber comprises a plurality of balls having a diameter less than said first large diameter opening in said cap and greater than said threaded bore.

3. Structure according to claim 2 wherein the cap includes a pair of said countersunk openings and a transverse passage from each first large diameter opening thereof to opposite ends of said second groove and a pair of bolts inserted through said bores to threadably engage said body whereby said ball members can be removed through either one of said transverse passages and said opening by means applying a pressure to the balls from the other transverse passage.

4. Structure according to claim 3 wherein said mounting means further comprises a shim plate interposed in said socket between said body and said cap to radially locate the axis of the cutter member on said tool body.

5. Structure according to claim 3 wherein said cap is generally cylindrical and said socket is likewise generally cylindrical and wherein said means for capturing said end portion of said axle includes an elongated slot open to the back face of said cap member.

6. Structure according to claim 5 wherein said first grooves are disposed in the opposed arcuate endwalls of opposed cylindrical sockets.

7. Structure according to claim 6 further including means for locking said bolts within said countersunk bore.

* * * * *